US006647365B1

(12) United States Patent
Faller

(10) Patent No.: US 6,647,365 B1
(45) Date of Patent: Nov. 11, 2003

(54) METHOD AND APPARATUS FOR DETECTING NOISE-LIKE SIGNAL COMPONENTS

(75) Inventor: Christof Faller, Taegerwilen (CH)

(73) Assignee: Lucent Technologies Inc., Murray Hill, NJ (US)

( * ) Notice: Subject to any disclaimer, the term of this patent is extended or adjusted under 35 U.S.C. 154(b) by 277 days.

(21) Appl. No.: 09/586,068

(22) Filed: Jun. 2, 2000

(51) Int. Cl.[7] ..... G10L 19/00

(52) U.S. Cl. ..... 704/200.1; 704/233; 704/500; 704/503

(58) Field of Search ..... 704/233, 200.1, 704/500–504

(56) References Cited

U.S. PATENT DOCUMENTS

| | | | | | |
|---|---|---|---|---|---|
| 5,394,473 | A | * | 2/1995 | Davidson | 375/240 |
| 5,581,653 | A | * | 12/1996 | Todd | 704/206 |
| 5,623,577 | A | * | 4/1997 | Fielder | 704/200.1 |
| 5,632,003 | A | * | 5/1997 | Davidson et al. | 704/200.1 |
| 5,732,189 | A | * | 3/1998 | Johnston et al. | 704/203 |
| 5,778,335 | A | * | 7/1998 | Ubale et al. | 704/219 |
| 5,781,888 | A | * | 7/1998 | Herre | 704/200.1 |

* cited by examiner

*Primary Examiner*—Doris H. To
*Assistant Examiner*—Michael N. Opsasnick

(57) ABSTRACT

Noise-like signal components are detected within arbitrary regions of the time-frequency plane. Various transforms are applied to G time domain samples with different spectral/temporal resolutions. The flatness of the time domain samples and the frequency samples for each transform are compared. If the computed flatness measures are about the same, the samples are assumed to be noisy. Noise-like signal components can be detected using a general filterbank within a limited time interval and frequency range by decomposing the signal into N subbands. To each group of G subband samples in time $\{t_k\}$, a linear orthogonal transform is applied to obtain the frequency domain samples $\{f_i\}$. The flatness of the time domain samples is compared to the flatness of the frequency domain samples $\{f_i\}$. A filterbank with uniform frequency-tiling can be used to detect noise-like signal components. To detect noise with a bandwidth of a given noise detection partition, two linear transforms are applied to the coefficients within the partition. A linear orthogonal synthesis transform is applied over frequency and a linear orthogonal analysis transform is applied over time in a noise detection partition to yield coefficients with maximum time and frequency resolution $\{t_k\}$ and $\{f_i\}$, respectively. The flatness of the time domain samples $\{t_k\}$ and the frequency domain samples $\{f_i\}$ are compared to decide whether the frequency noise detection partition is noise-like. Noise with a non-flat spectrum can be detected by preprocessing the signal according to its inverse spectral envelope before detecting noise-like signal components with a non-flat spectral/temporal envelope.

18 Claims, 6 Drawing Sheets

METHOD AND APPARATUS FOR DETECTING NOISE-LIKE SIGNAL COMPONENTS

CROSS-REFERENCE TO RELATED APPLICATION

The present invention is related to U.S. patent application Ser. No. 09/586,072, entitled "Perceptual Coding of Audio Signals Using Separated Irrelevancy Reduction and Redundancy Reduction," U.S. patent application Ser. No. 09/586,071, entitled "Method and Apparatus for Representing Masked Thresholds in a Perceptual Audio Coder,". U.S. patent application Ser. No. 09/586,070, entitled "Perceptual Coding of Audio Signals Using Cascaded Filterbanks for Performing Irrelevancy Reduction and Redundancy Reduction With Different Spectral/Temporal Resolution," and U.S. patent application Ser. No. 09/586,069, entitled "Method and Apparatus for Reducing Aliasing in Cascaded Filter Banks," filed contemporaneously herewith, assigned to the assignee of the present invention and incorporated by reference herein.

FIELD OF THE INVENTION

The present invention relates generally to signal processing techniques, and more particularly, to methods and apparatus for detecting noise in signals, such as audio signals.

BACKGROUND OF THE INVENTION

Noise detection schemes have many applications in signal processing and signal analysis. A good noise detection measure can improve noise reduction algorithms. In the study of the properties of a signal, the detection of noise-like signal components can be an important part of the analysis. In modeling and control engineering applications, for example, the identification of noisy signal components can help find an optimal model structure or the identified noisy signal components can be used as input parameters for the model. In audio or image compression schemes, noise-like signal components do not need to be encoded and thus the number of encoded bits can be reduced. Only the parameters that are necessary to generate similar noise-like components are transmitted to the decoder. The decoder artificially generates similar noise-like components during the synthesis of the signal.

Currently available noise detection methods, such as those used in speech coders described, for example, in W. B. Kleijn and K. K. Paliwal, "An Introduction to Speech Coding,"

Speech Coding and Synthesis, Amsterdam: Elsevier, (1995), incorporated by reference herein, are typically based on a spectral flatness measure. In a general application, however, such a measure can fail by detecting the flat spectrum of an impulse signal as noise.

The MPEG-2 AAC audio encoder described, for example, in ISO/JTC1 SC29 WG11, Final Draft International Standard FDIS 14496-3: Coding of Audiovisual Objects, Part 3: Audio (October 1998), detects a range of spectral samples as noisy if the spectral samples are not tonal and there are no strong changes in energy over time. The tonality of the signal is estimated by using the tonality values calculated using a psychoacoustic model. The noise detection method of the MPEG-2 AAC is tightly linked to the infrastructure of a specific audio coder.

Thus, the noise detection method of the MPEG-2 AAC cannot be applied generally and its flexibility for use in other implementations of audio coding is limited.

A need therefore exists for an improved method and apparatus that detect noise-like signal components within arbitrary regions of the time-frequency plane. A further need exists for a method and apparatus that detect noise-like signal components that does not detect pulses as noise. Yet another need exists for a method and apparatus that detect noise-like signal components with a non-flat spectral or temporal envelope.

SUMMARY OF THE INVENTION

Generally, a method and apparatus are disclosed for detecting noise-like signal components within arbitrary regions of the time-frequency plane. G time domain samples are processed to determine whether they are noise-like. Various transforms, such as a discrete cosine transform (DCT), with different spectral/temporal resolutions are applied. The flatness of the time domain samples, such as an estimate of the entropy, is compared to the flatness of the samples for each transform. If the computed flatness measures are about the same, the subband samples $\{t_0, t_1, \ldots, t_{G-1}\}$ are assumed to be noisy.

According to one aspect of the invention, noise-like signal components can be detected within a limited time interval and frequency range by decomposing the signal into N (possibly non-uniform) spaced subbands using a general filterbank. In each of the N subbands, the samples are grouped into blocks of a specific length G. To each of these groups of G subband samples in time $\{t_0, t_1, \ldots, t_{G-1}\}$, a linear orthogonal transform is applied to obtain the frequency domain samples $\{f_0, f_1, \ldots, f_{G-1}\}$. Then, the flatness of the time domain samples is compared to the flatness of the samples of the linear orthogonal transform. If the computed flatness measures are about the same, the time domain samples are assumed to be noisy.

According to another aspect of the invention, a filterbank with uniform frequency-tiling such as an MDCT filterbank deployed in a perceptual audio coder (PAC), is used to detect noise-like signal components. Within the discrete representation of the time-frequency plane by the filterbank coefficients, noise detection partitions with appropriate time-frequency ranges can be chosen. A given noise detection partition with the size F over frequency and T over time contains the samples $S_{k,i}(0 \leqq k<F,\ 0 \leqq i<T)$. To detect noise with a bandwidth of a given noise detection partition, two linear transforms are applied to the coefficients within the partition. A linear orthogonal synthesis transform, such as an inverse DCT transform, is applied over frequency in a noise detection partition to yield coefficients with maximum time resolution $\{t_0, t_1, \ldots, t_{FT-1}\}$. A linear orthogonal analysis transform, such as a DCT transform, is applied within the noise detection partition over time to yield the highest possible frequency resolution coefficients $\{f_0, f_1, \ldots, f_{FT-1}\}$. The mapping from $t_0, t_1, \ldots, t_{TF-1}$, to $f_0, f_1, \ldots, f_{FT-1}$, provides the longest possible time-frequency transform within the noise detection partition. The flatness of the time domain samples $\{t_k\}$ is compared to the flatness of the frequency domain samples $\{f_i\}$ to decide whether the frequency noise detection partition is noise-like.

According to another aspect of the invention, noise with a non-flat spectrum can also be detected. The signal is pre-processed according to its inverse spectral envelope before detecting noise-like signal components with a non-flat spectral or temporal envelope. The spectral coefficients of the filterbank are scaled before applying the noise-detection measure. By scaling the coefficients with a coarse approximation of their spectral envelope $\{S_k\}$ prior to the detection, noise-like signal components with a non-flat spectral/temporal envelope can be detected using the condition for noise with a flat spectral/temporal envelope. In an audio coder implementation, for example, this feature can be implemented by scaling the spectral coefficients according to the perceptual model prior to the noise detection, since the masked threshold is roughly proportional to the spectral envelope of the signal.

A more complete understanding of the present invention, as well as further features and advantages of the present invention, will be obtained by reference to the following detailed description and drawings.

DETAILED DESCRIPTION

Figure 1:
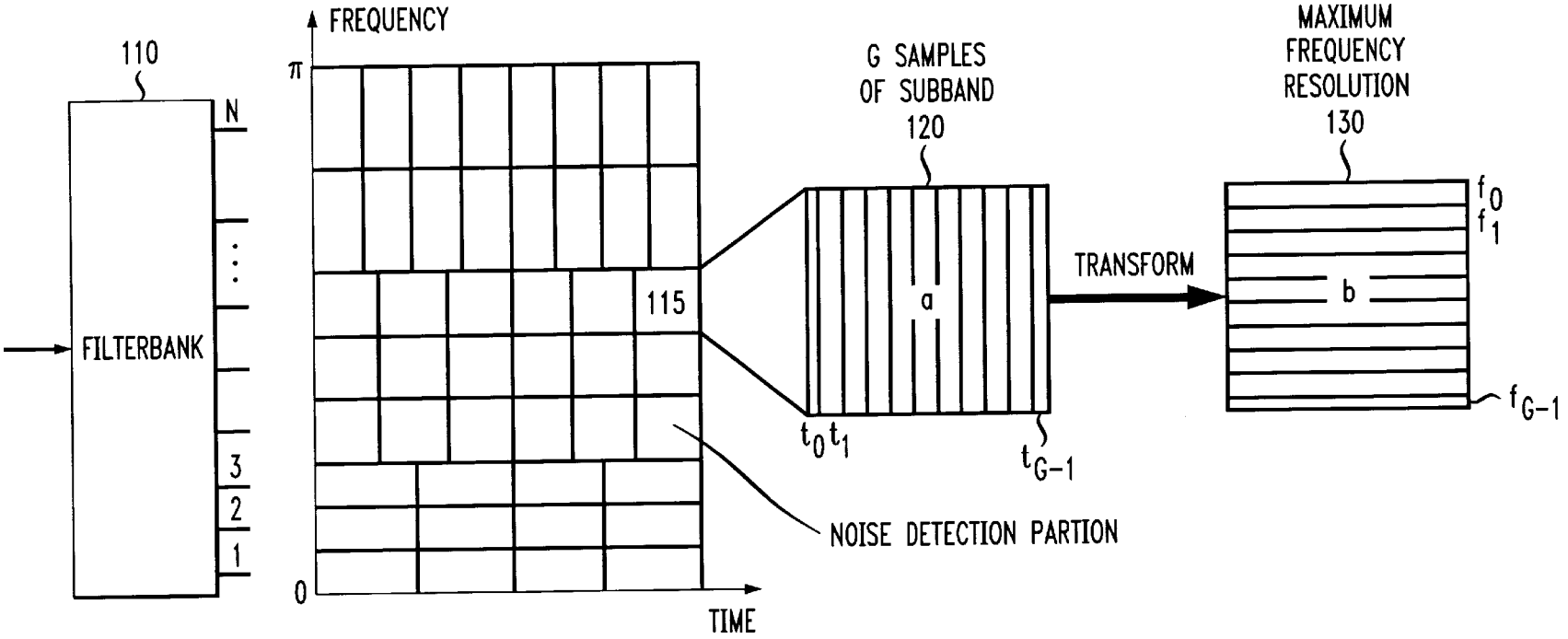
FIG. 1 illustrates a filterbank that partitions a signal into N frequency subbands that may be analyzed to detect noise-like signal components in accordance with the present invention.

The present invention provides a method and apparatus for detecting noise-like signal components within arbitrary regions of the time-frequency plane. According to one feature of the present invention, the flatness of samples are compared with different spectral/temporal resolutions thus preventing the detection of impulse signals as noise.

Detecting White Noise

Generally, G time domain samples are processed to determine whether they are noise-like. Various transforms, such as a discrete cosine transform (DCT), with different spectral/temporal resolutions are applied. The flatness of the time domain samples, such .as an estimate of the entropy, is compared to the flatness of the samples for each transform. If all computed flatness measures are about the same, it is assumed that the time domain samples are noisy.

Thus, for a linear orthogonal transform A, of length G (e.g., DCT) applied to the time-domain samples $\{t_k\}$ $(0 \leqq k < G)$, $$f = At \tag{1}$$

with $$t = \begin{pmatrix} t_0 \\ t_1 \\ \cdots \\ t_{G-1} \end{pmatrix} \text{ and } f = \begin{pmatrix} f_0 \\ f_1 \\ \cdots \\ f_{G-1} \end{pmatrix} \tag{1}$$

the variances $\sigma^2_{fi}(0 \leqq i \leqq G)$ of the spectral coefficients $\{f_i\}$ can be calculated as the diagonal elements of the covariance matrix $R_{ff}$ of the coefficients of the transform, $$R_{ff} = E\{ff^T\} = AR_{tt}A^T$$

For white noise, the variances of the spectral coefficients after the transform $\{f_i\}$ become $$\sigma^2_{fi} = \sigma_t^2 (O \leqq i < G) \tag{2}$$

with the variance of the input signal $\sigma_t^2$. Therefore, for stationary signals a measure to detect white noise is the condition that Equation 2 is satisfied. In practice, however, the condition of Equation 2 is not very useful. The variance $\sigma_t^2$ can be estimated with the given G time-domain samples, but the variances $\sigma_i^2$ cannot be estimated well because there is only one sample in each subband i.

To derive an improved noise-detection condition, white noise with a Gaussian distribution is considered. If white noise $\{t_k\}$ has a Gaussian distribution $p_t$, the spectral coefficients $\{f_i\}$ (Equation 1) also have a gaussian distribution (a sum of gaussian random, variables is gaussian). With Equation 2, it follows that all the spectral coefficients have the same distribution:

$$p_i = p_i (o \leqq i < G) \tag{3}$$

The entropy of two discrete random variables with the same distribution is the same. Thus, if the samples $\{t_k\}$ are white gaussian noise then the entropy of the samples $\{t_k\}$ and $\{f_i\}$ is the same, $$\text{Entropy}(\{t_k\}) = \text{Entropy}(\{f_i\}). \tag{4}$$

By estimating the entropies, Equation 4 becomes:

$$\frac{1}{G}\sum_{k=0}^{G-1} \log(t_k^2 + \varepsilon) \approx \frac{1}{G}\sum_{i=0}^{G-1} \log(f_i^2 + \varepsilon) \tag{5}$$

where $\epsilon$ is a small positive number to reduce the influence of very small values. As previously indicated, flatness measures other than the entropy could be also used to estimate the condition of Equation 3. To decide whether the samples $\{t_k\}$ are noise-like, the relative difference between the entropy estimations on the left and right side of Equation 5 is computed, $$\left|\frac{\frac{1}{G}\sum_{k=0}^{G-1}\log(t_k^2+\varepsilon)-\frac{1}{G}\sum_{i=0}^{G-1}\log(f_i^2+\varepsilon)}{\frac{1}{G}\sum_{k=0}^{G-1}\log(t_k^2+\varepsilon)}\right|<\varepsilon \tag{6}$$

If the relative difference is smaller than $\epsilon$ then the samples $\{t_k\}$ are noise-like.

To improve the robustness of the noise-detection, several transforms (Equation 1) with different spectral/temporal resolutions can be carried out and Equation 6 is verified for the samples of each transform. Detecting Noise-Like Signal Components Within a Limited Time Interval and Frequency Range

Noise Detection with a General Filterbank

To detect noise-like signal components within a limited time interval and frequency range, the signal is decomposed into N (possibly non-uniform) spaced subbands by a filterbank 110, shown in FIG. 1. The frequency ranges of the signal components that are to be detected as noise-like are determined by the frequency tiling of the filterbank 110. FIG. 1 illustrates a filterbank 110 that partitions a signal into N frequency subbands that may be analyzed to detect noise-like signal components in accordance with the present invention.

In each of the N subbands, the samples are grouped into blocks of a specific length G, as shown by the enlarged view 120 in the frequency domain of noise detection partition 115. G determines the length in time of the signal component to be detected as noisy. To each of these groups of G subband samples in time $\{t_0, t_1, \ldots, t_{G-1}\}$, a linear orthogonal transform (Equation 1) is applied to obtain the frequency domain samples $\{f_0, f_1, \ldots, f_{G-1}\}$, as shown by the enlarged view 130 in the frequency domain of noise detection partition 115. Then, the noise detection condition of Equation 6 is verified.

Noise Detection with a Uniform Filterbank

The general scheme described above in conjunction with FIG. 1 can also be implemented with a filterbank with uniform frequency-tiling such as an MDCT filterbank deployed in a perceptual audio coder (PAC), such as the perceptual audio coder described in D. Sinha et al., "The Perceptual Audio Coder," Digital Audio, Section 42, 42-1 to 42-18, (CRC Press, 1998), incorporated by reference herein. Within the discrete representation of the time-frequency plane by the filterbank coefficients, noise detection partitions with appropriate time-frequency ranges can be chosen.

Figure 2:
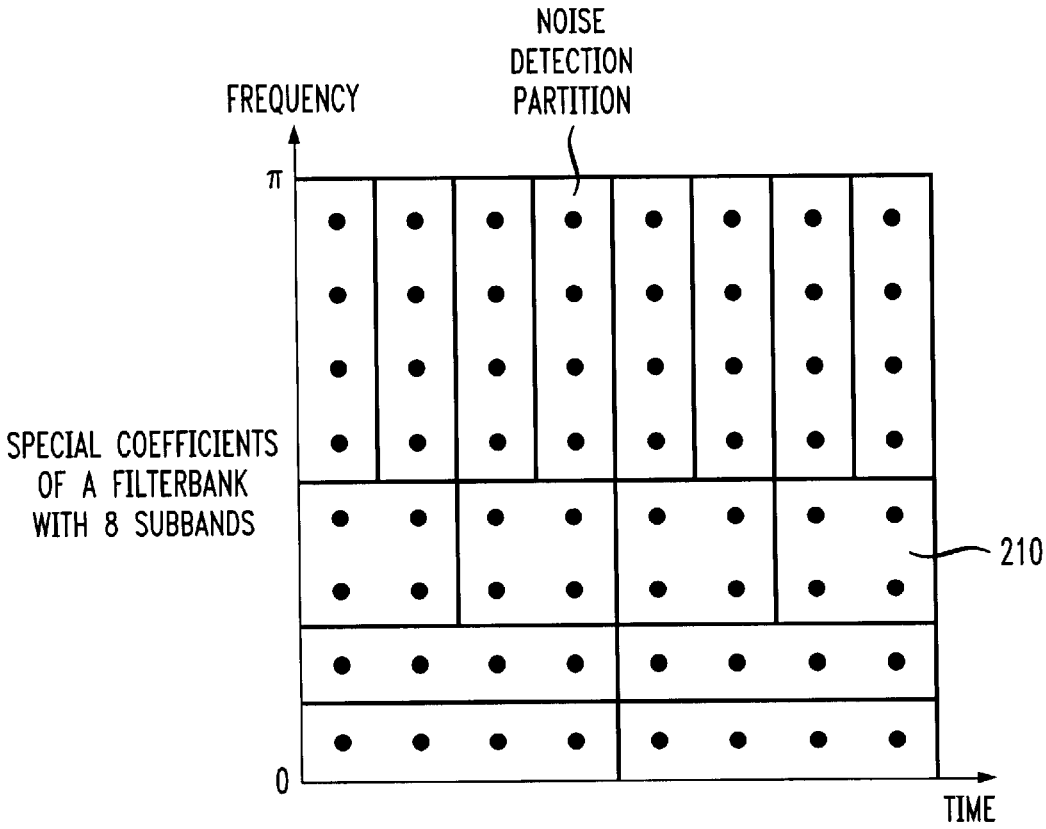
FIG. 2 illustrates an example of noise detection partitions in accordance with one embodiment of the present invention in a transform coder having a transform size of eight (8)
Figure 3:
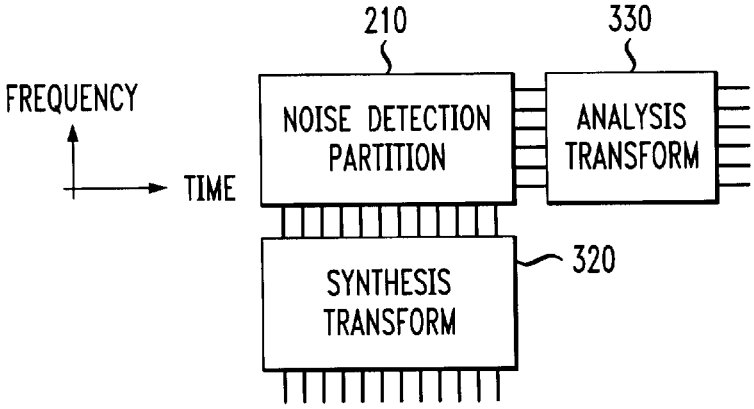
FIG. 3 illustrates another embodiment of the present invention where two linear transforms are applied to the coefficients within a given noise detection partition of FIG. 2.

FIG. 2 illustrates an example of noise detection partitions in accordance with the present invention in a transform coder having a transform size of eight (8). A given noise detection partition, such as the noise detection partition 210, with the size F over frequency and T over time contains the samples $s_{k,i}(0\leqq k<F, 0\leqq i<T)$. To detect noise with a bandwidth of the given noise detection partition 210, two linear transforms are applied to the coefficients within the partition, as shown in FIG. 3.

A linear orthogonal synthesis transform B, such as an inverse DCT transform, applied by block 320 over frequency in the noise detection partition 210 yields coefficients with maximum time resolution $\{t_0, t_1, \ldots, t_{FT-1}\}$, $$s_i=\begin{pmatrix} s_{i,0} \\ s_{i,1} \\ \cdots \\ s_{i,F-1}\end{pmatrix} \quad \text{and} \quad t_i=\begin{pmatrix} t_{iT} \\ t_{iT+1} \\ \cdots \\ t_{iT+F-1}\end{pmatrix}$$

A linear orthogonal analysis transform C, such as a DCT transform, applied by block 330 within the noise detection partition 210 over time yields the highest possible frequency resolution coefficients $\{f_0, f_1, \ldots, f_{FT-1}\}$, $$s_k=\begin{pmatrix} s_{0,k} \\ s_{1,k} \\ \cdots \\ s_{T-1,k}\end{pmatrix} \quad \text{and} \quad f_i=\begin{pmatrix} f_{kF} \\ f_{kF+1} \\ \cdots \\ f_{kF+T-1}\end{pmatrix}$$

The mapping from $t_0, t_1, \ldots, t_{FT-1}$, to $f_0, f_1, \ldots, f_{FT-1}$, is the longest possible time-frequency transform within the noise detection partition. This also corresponds to the transform used above in the subsection entitled "Noise Detection with a General Filterbank," to detect noise (Equation 1). The noise-detection condition of Equation 6 is applied to the samples $\{t_k\}$ and $\{f_i\}$ to decide whether the noise detection partition is noise-like.

In this manner, the time resolution can be increased prior to the flatness estimation where the filterbank has a higher frequency resolution than desired by applying additional inverse transforms to the samples of neighboring subbands.

Detect Noise-Like Signal Components with a Non-Flat Spectral or Temporal Envelope According to another feature of the present invention, noise with a non-flat spectrum can also be detected. If the signal is pre-processed according to its inverse spectral envelope before detecting noise-like signal components, the method described above can be used to detect noise-like signal components with a non-flat spectral or temporal envelope.

Figure 4:
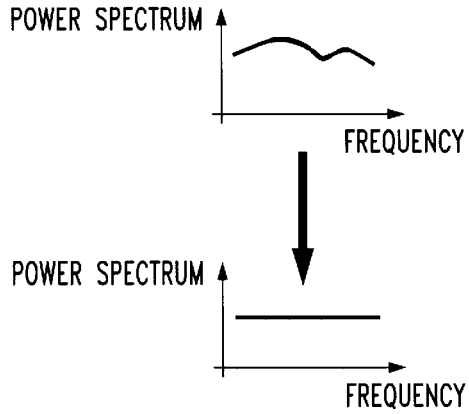
FIG. 4 illustrates the scaling of the spectral coefficients of the filterbank in accordance with another embodiment of the present invention that detects noise-like signal components with a non-flat spectral/temporal envelope.

As shown in FIG. 4, the spectral coefficients of the filterbank described above in the section entitled "Detecting Noise-Like Signal Components Within a Limited Time Interval and Frequency Range," are scaled before applying the noise-detection measure. By scaling the coefficients with a coarse approximation of their spectral envelope $\{S_k\}$ prior to the detection, $$\tilde{c}_k=\frac{1}{\sqrt{S_k}}c_k \tag{9}$$

noise-like signal components with a non-flat spectral/temporal envelope can be detected using the condition for noise with a flat spectral/temporal envelope. The resolution/detail-level of the spectral envelope used determines the degree to which non-flat noise components are detected as noise-like by the condition of Equation (6).

In an audio coder implementation, this feature of the present invention can be conveniently implemented by scaling the spectral coefficients according to the perceptual model prior to the noise detection, since the masked threshold is roughly proportional to the spectral envelope of the signal.

Application of Noise-Detection in Audio Coding

It can been shown that noise-like signal components can be replaced by artificially generated noise-like signal components without being perceivable (if a conservative noise detection condition is used) or without being perceived as an artifact (if the noise detection condition is less conservative).

At lower bit rates, such as bit rates below 64 kbit/s for a CD quality source signal, there are not enough bits available to encode a signal at transparent quality. Thus, if bits can be saved by not coding noise-like components of the audio signal, more bits are available for coding the remaining part of the signal.

Figure 5:
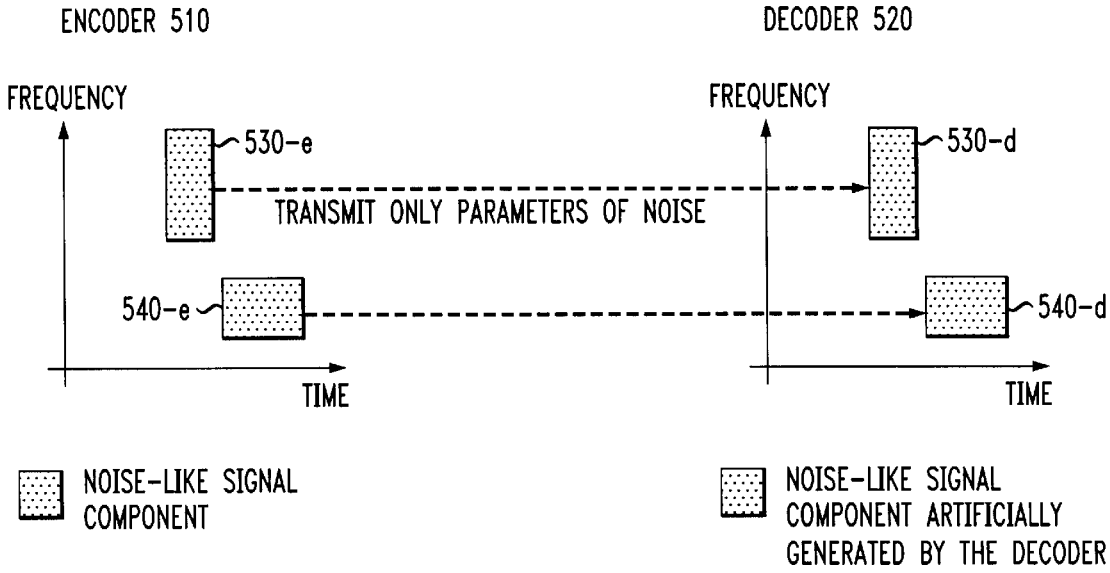
FIG. 5 illustrates the transmission of an audio signal from an encoder to a decoder where detected noise-like signal component are not encoded or transmitted.
Figure 6:
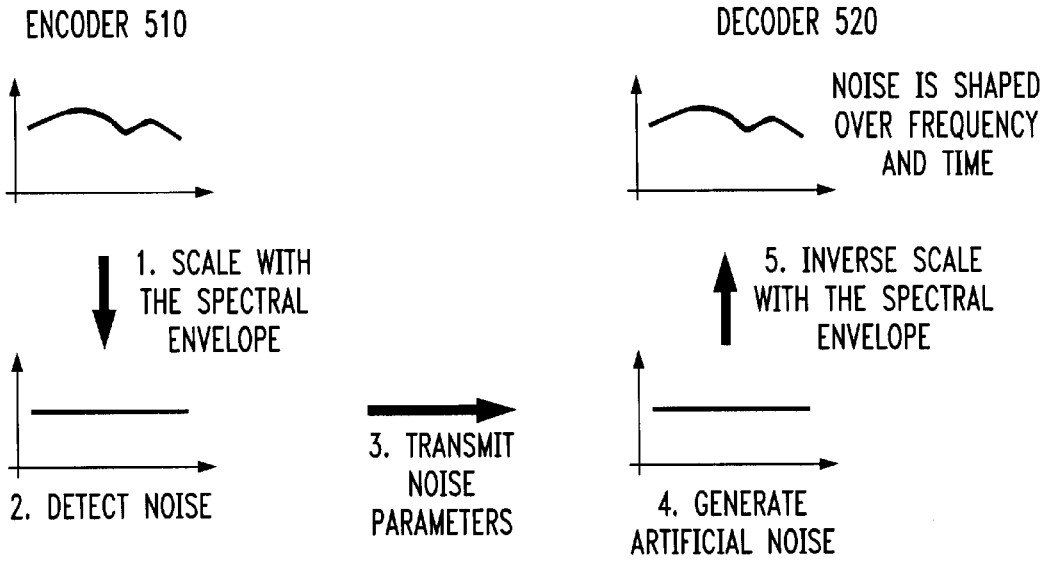
FIG. 6 illustrates the processing steps performed by the audio encoder and decoder embodying features of the present invention to implement a scheme that does not transmit noise-like signal components.

As shown in FIG. 5, if an audio encoder 510 detects a signal component as noise-like, such as components 530-e, 540-e, the signal component is not encoded. Only the parameters necessary to generate a similar noise-like signal component are transmitted to the decoder 520. Specifically, only the standard deviation of the noise and its spectral envelope are encoded. The decoder generates the noise-like signal components 530-d, 540-d and includes the noise-like signal component into the decoded signal. FIG. 6 shows the steps carried out in the audio encoder 510 and decoder 520 to implement a scheme that does not transmit noise-like signal-components.

As shown in FIG. 6, the spectral coefficients coming out of the filterbank are initially scaled during step 1 to flatten the signal spectrum (Equation 9). Thereafter, for each noise detection partition, the noise detection condition (Equation 3, 4, or 5) is evaluated during step 2 to determine whether the component is noisy. If it is determined during step 2 that the signal component corresponding to the noise detection partition is noise-like, then the signal component is not encoded. Instead, the parameters necessary to artificially generate the signal component are transmitted during step 3 (the standard deviation of the noise and its spectral envelope).

The decoder generates white noise during step 4 with the variance of the original noisy signal component. The generated white noise is scaled during step 5 to have the envelope of the original noisy signal component.

As previously indicated, the masked threshold that is transmitted as side information from the audio encoder to the audio decoder (often referred to as "scale-factors") is proportional to a coarse approximation of the signal's spectral envelope. Thus, scaling the spectral coefficients according to the masked threshold prior to the noise detection has a similar effect as scaling according to the spectral envelope (Equation 9). Thus, there is no additional side information that needs to be transmitted to the decoder.

Implementation in PAC

Figure 7:
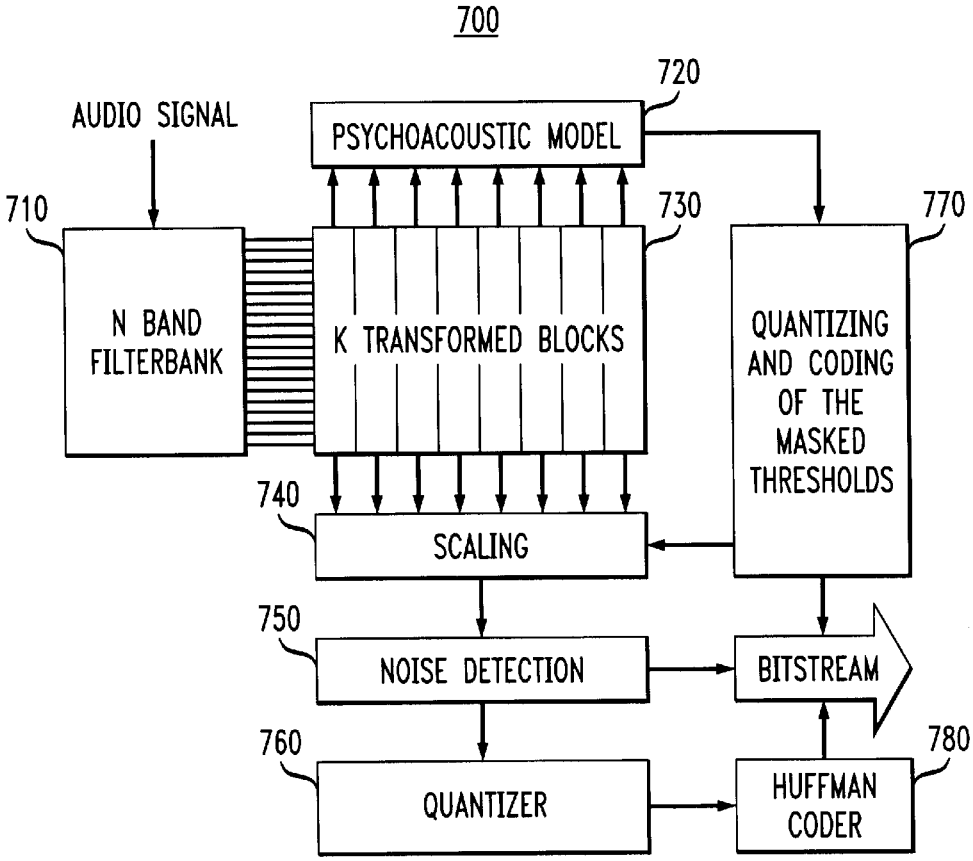
FIG. 7 illustrates the integration of the noise detection scheme of the present invention with the short MDCT mode (128 bands) of a perceptual audio coder.

FIG. 7 illustrates how the noise detection scheme of the present invention can be integrated into the short MDCT mode (128 bands) of a perceptual audio coder 700. An N band filterbank 710 decomposes the audio signal into N subbands. Each group of G subband samples in time $\{t_0, t_1, \ldots, t_{G-1}\}$ are transformed at stage 730 using a linear orthogonal transform to obtain the frequency domain samples $\{f_0, f_1, \ldots, f_{G-1}\}$. The masked threshold is obtained in accordance with the psychoacoustic model 720. The frequency domain samples $\{f_0, f_1, \ldots, f_{G-1}\}$ are then scaled at stage 740, before applying the noise-detection measure at stage 750, so that noise-like signal components with a non-flat spectral/temporal envelope can be detected.

The noise detection block 750 detects noise-like coefficients and removes them. The quantizer 760 quantizes the remaining samples, which are encoded by the Huffman coder 780, in a known manner. The standard deviation of the noise-like coefficients is transmitted to the decoder (not shown). The masked threshold is used as an approximation of the spectral envelope of the noise so the spectral envelope is not transmitted to the decoder.

Figure 8:
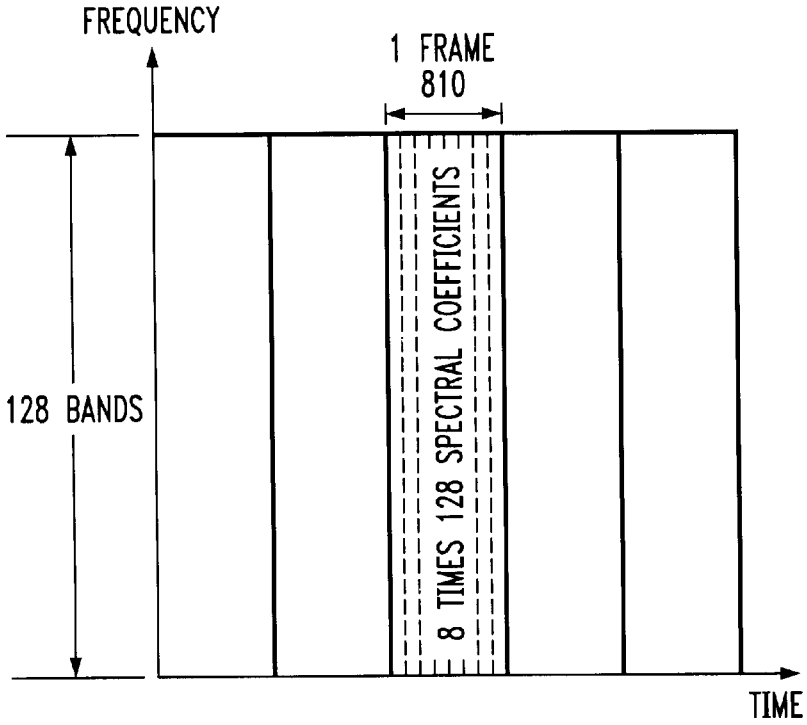
FIG. 8 illustrates the processing of a frame in a perceptual audio coder in a short transform window (128 band MDCT) mode in accordance with the present invention.
Figure 9:
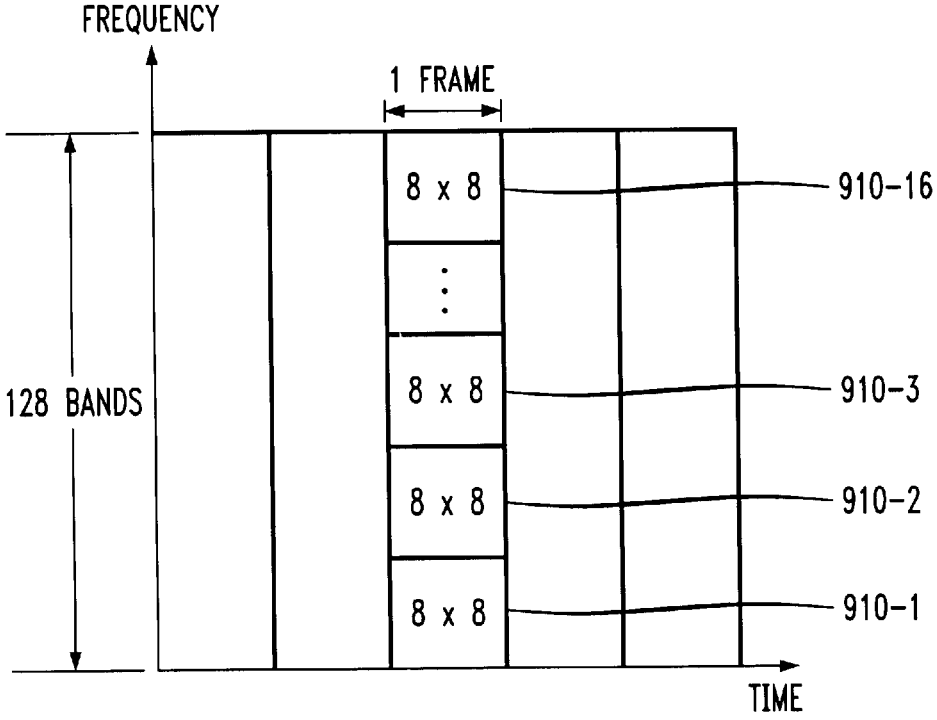
FIG. 9 illustrates the partitioning of the matrix of FIG. 8 into 16 noise detection partitions.

A PAC, such as the PAC 700 shown in FIG. 7, processes a frame when it is in short transform window (128 band MDCT) mode as follows:

PAC always processes frames of 1024 samples at once. Thus, as shown in FIG. 8, eight 128 band MDCTs are carried out at once yielding 8 time 128 spectral samples. This matrix 810 of 8 times 128 (scaled) samples is available at once for processing. The matrix 810 is partitioned into 16 noise detection partitions 910-1 through 910-16, each with 8 by 8 samples, as shown in FIG. 9. To each of these noise detection partitions 910-n, orthogonal DCT transforms are applied (Equations 7 and 8) and the condition of Equation 6 is checked.

If a given 8 by 8 noise detection partition 910-n is found to be noise-like, its coefficients are not encoded and not transmitted to the decoder. Instead, only the standard deviation of the noise in the noise detection partition is transmitted to the decoder. During the synthesis of the signal, the decoder substitutes the samples of each noise-like noise detection partition with white noise and scales them according to the masked threshold. The resulting noise has an envelope similar to the envelope of the original noise.

In order to integrate the noise-detection and substitution into a PAC, the PAC must be modified such that coefficients of noise-like noise detection partitions are not encoded and written to the bitstream. Additionnally, the standard deviations of the noise in noisy partitions must be written to the bitstream.

Figure 10:
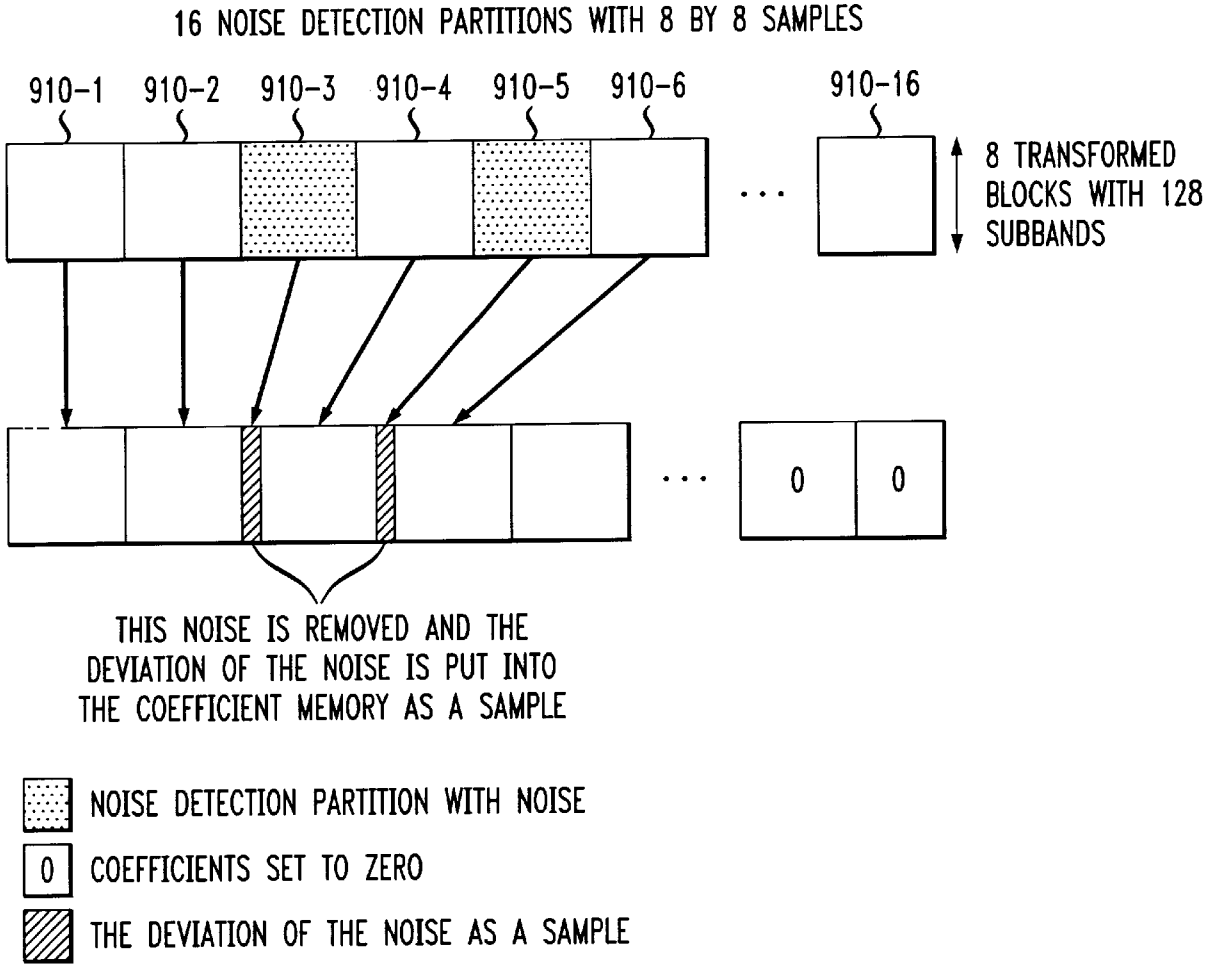
FIG. 10 illustrates the processing of the spectral samples in a PAC and their partitioning into 16 noise detection partitions in accordance with the present invention.

The top part of FIG. 10 illustrates the spectral samples processed at once in a PAC coder and their partitioning into 16 noise detection partitions 910. In the example shown in FIG. 10, the grey partitions, such as partitions 910-3, 910-5, are noisy. To remove the coefficients in noisy partitions 910-3, 910-5, the samples of non-noisy partitions are moved to the location of the noisy partitions. The standard deviations corresponding to the noise in the noisy partitions is put into the coefficient memory as a value. Thus, the standard deviations are quantized and coded in the same manner as the other spectral coefficients.

It is to be understood that the embodiments and variations shown and described herein are merely illustrative of the principles of this invention and that various modifications may be implemented by those skilled in the art without departing from the scope and spirit of the invention.

I claim:

1. A method for detecting noise-like signal components in a signal, comprising the steps of:

filtering said signal into N spaced subbands to obtain subband samples $\{t_k\}$ in time;

applying a transform to each of said subbands to obtain frequency domain samples $\{f_i\}$;

comparing the flatness of said subband samples $\{t_k\}$ to the flatness of the frequency domain samples $\{f_i\}$; and detecting said noise-like signal components if said comparing step satisfies a predefined criteria.

2. The method of claim 1, wherein said transform is a linear orthogonal transform.

3. The method of claim 2, wherein said linear orthogonal transform is applied to groups of G subband samples.

4. The method of claim 1, wherein said subbands are not uniformly spaced.

5. The method of claim 1, wherein said predefined criteria is that said flatness measures are approximately the same for said subband samples and said frequency domain samples.

6. The method of claim 1, wherein said subbands are produced by a filterbank with uniform frequency-tiling.

7. The method of claim 6, wherein said filterbank is an MDCT filterbank.

8. The method of claim 1, further comprising the steps of applying a linear orthogonal synthesis transform over frequency and a linear orthogonal analysis transform over time in a noise detection partition to yield coefficients with maximum time and frequency resolution.

9. The method of claim 8, wherein said linear orthogonal synthesis transform is an inverse DCT transform.

10. The method of claim 8, wherein said linear orthogonal analysis transform is a DCT transform.

11. The method of claim 1, further comprising the step of scaling said samples with an approximation of their spectral envelope $\{S_k\}$ prior to said comparison step.

12. A method for detecting noise-like signal components in a signal, comprising the steps of:

filtering said signal into N spaced subbands to obtain subband samples $\{t_k\}$ in time;

allocating a plurality of noise detection partitions, each of said noise detection partitions having a size F over frequency and a size T over time;

applying a linear orthogonal synthesis transform over frequency in a noise detection partition to yield the subband samples $\{t_k\}$;

applying a linear orthogonal analysis transform over time in said noise detection partition to yield the frequency samples $\{f_i\}$;

comparing the flatness of said subband samples $\{t_k\}$ to the flatness of the frequency domain samples $\{f_i\}$; and detecting said noise-like signal components if said comparing step satisfies a predefined criteria.

13. The method of claim 12, wherein said linear orthogonal synthesis transform is an inverse DCT transform.

14. The method of claim 12, wherein said linear orthogonal analysis transform is a DCT transform.

15. The method of claim 12, wherein said predefined criteria is that said flatness measures are approximately the same for said time domain samples and said frequency domain samples.

16. A system for detecting noise-like signal components in a signal, comprising:

means for filtering said signal into N spaced subbands to obtain subband samples $\{t_k\}$ in time;

means for applying a transform to each of said subbands to obtain frequency domain samples $\{f_i\}$;

means for comparing the flatness of said subband samples $\{t_k\}$ to the flatness of the frequency domain samples $\{f_i\}$; and means for detecting said noise-like signal components if said comparing step satisfies a predefined criteria.

17. A system for detecting noise-like signal components in a signal, comprising:

means for filtering said signal into N spaced subbands to obtain subband samples $\{t_k\}$ in time;

means for allocating a plurality of noise detection partitions, each of said noise detection partitions having a size F over frequency and a size T over time;

means for applying a linear orthogonal synthesis transform over frequency in a noise detection partition to yield the subband samples $\{t_k\}$;

means for applying a linear orthogonal analysis transform over time in said noise detection partition to yield the frequency samples $\{f_i\}$;

means for comparing the flatness of said subband samples $\{t_k\}$ to the flatness of the frequency domain samples $\{f_i\}$; and means for detecting said noise-like signal components if said comparing step satisfies a predefined criteria.

18. A system for detecting noise-like signal components in a signal, comprising:

a noise detection partition for filtering said signal into N spaced subbands to obtain subband samples $\{t_k\}$ in time;

a linear orthogonal synthesis transform block applied to said signal over frequency to provide coefficients with time resolution $\{t_0, t_1, \ldots, t_{FT-1}\}$;

a linear orthogonal analysis transform block applied to said signal over time to provide coefficients with frequency resolution $\{f_0, f_1, \ldots, f_{FT-1}\}$, a comparator for comparing the flatness of said subband samples $\{t_k\}$ to the flatness of the frequency domain samples $\{f_i\}$; and a detector for detecting said noise-like signal components if said comparing step satisfies a predefined criteria.

* * * * *